United States Patent [19]

Van Gompel

[11] 4,403,556

[45] Sep. 13, 1983

[54] DRUM RETAINER

[75] Inventor: James J. Van Gompel, Fremont, Ind.

[73] Assignee: NP Marketing Corporation, Neenah, Wis.

[21] Appl. No.: 269,409

[22] Filed: Jun. 4, 1981

[51] Int. Cl.[3] ..... B65D 19/44

[52] U.S. Cl. ..... 108/55.3; 108/55.5

[58] Field of Search ..... 108/55.1–55.5, 108/51.1, 53.1, 53.3, 57.1; 292/257; 206/386

[56] References Cited

U.S. PATENT DOCUMENTS

| | | | |
|---|---|---|---|
| 1,379,162 | 5/1921 | Brown | 292/257 |
| 1,700,620 | 1/1929 | Yunek | 292/257 |
| 2,626,456 | 1/1953 | Harrison | 108/55.5 X |
| 3,361,465 | 1/1968 | Dobbs | 292/257 |
| 3,431,870 | 3/1969 | Naylor et al. | 108/55.1 |
| 3,636,888 | 1/1972 | Angelbeck, Jr. | 108/53.1 |
| 3,654,875 | 4/1972 | Vik | 108/53.1 |
| 3,858,723 | 1/1975 | Weiss | 108/55.3 X |
| 4,305,505 | 12/1981 | Hickey | 108/55.1 X |

FOREIGN PATENT DOCUMENTS

| | | | |
|---|---|---|---|
| 773948 | 5/1957 | United Kingdom | 108/55.5 |
| 590188 | 1/1978 | U.S.S.R. | 108/55.1 |

*Primary Examiner*—William E. Lyddane

*Attorney, Agent, or Firm*—Andrus, Sceales, Starke & Sawall

[57] ABSTRACT

The drum retainer includes a platform for supporting a plurality of drums thereon in an upright condition. A hold-down mechanism extends upright from the platform with the drums arranged circumferentially relative thereto. The hold-down mechanism engages the tops of the drums and provides for their securement between the hold-down mechanism and the platform. The platform is spaced above the floor by floor contacting members having teeth that penetrate the floor by virtue of the weight of the drum laden retainer to generally restrain the drum retainer against movement.

13 Claims, 6 Drawing Figures

Fig. 4
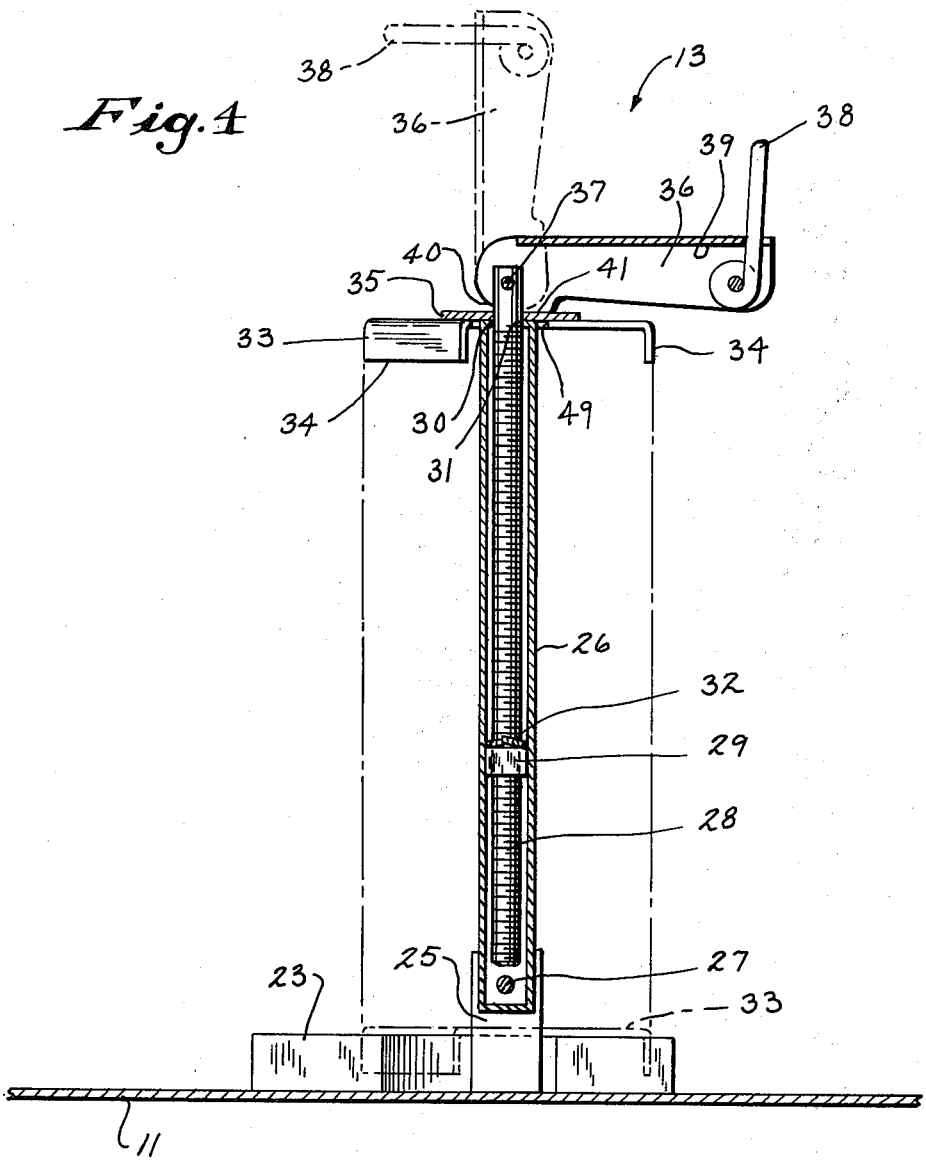
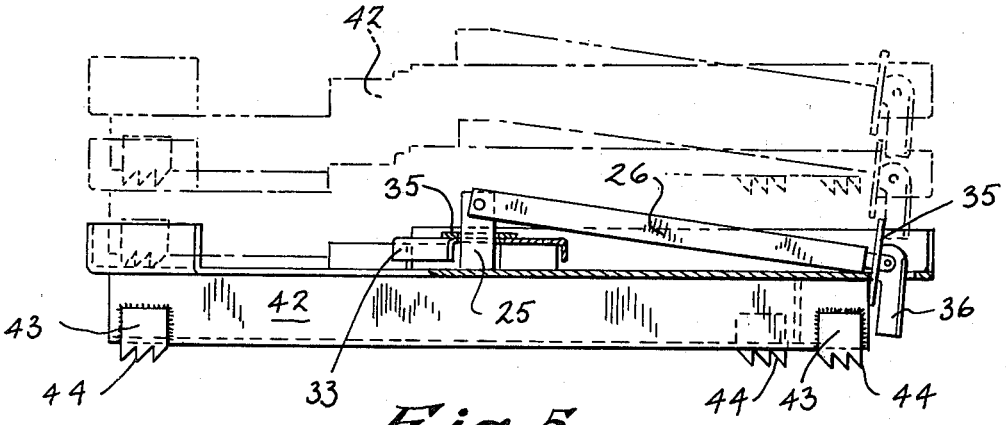
Fig. 5

DRUM RETAINER

BACKGROUND OF THE INVENTION

This invention relates to drum retaining means which can be variously used during shipment of drum cargo to generally maintain the integrity of the cargo load.

Drums are utilized to package a host of solid and liquid materials. Heretofore, blocking and/or bracing have largely been relied upon to secure a cargo load of drums when enroute. Such practices are not only time consuming and costly, but also rely heavily on individual judgment for their adequacy. All too often, the blocking and/or bracing have proven inadequate giving rise to loads shifting with consequent puncturing and bursting of drums and tops popping off. The resultant spillage and/or leakage is at best messy, sometimes costly, and when hazardous materials are involved, even threatening to life and property. It is generally an object of this invention to provide drum retaining means to more reliably secure the integrity of drum cargo when enroute.

SUMMARY OF THE INVENTION

The drum retainer of this invention broadly includes platform means for supporting drums thereon disposed on end in an upright condition. Hold-down means extend upright from the platform means with the drums being arranged circumferentially relative to the hold-down means. The drums are engaged at their top by the hold-down means to provide for their securement between the hold-down means and the platform means. A plurality of floor contacting means are disposed beneath the platform means to space the platform means above the floor. The floor contacting means include floor piercing means which project downwardly therefrom to engage and pierce the floor to thereby generally restrain the drum retainer against movement.

DESCRIPTION OF THE DRAWING FIGURES

The drawings furnished herewith illustrate the best mode presently contemplated for carrying out the invention and are described hereinafter.

In the drawings:

FIG. 4 is a detail sectional view showing the drum hold-down means with the threaded member telescoped into the nut confinement tube;

FIG. 5 is a side elevation showing the drum retaining means of this invention stacked and nested for shipment and/or storage.

DESCRIPTION OF THE ILLUSTRATED EMBODIMENT

Figure 1:
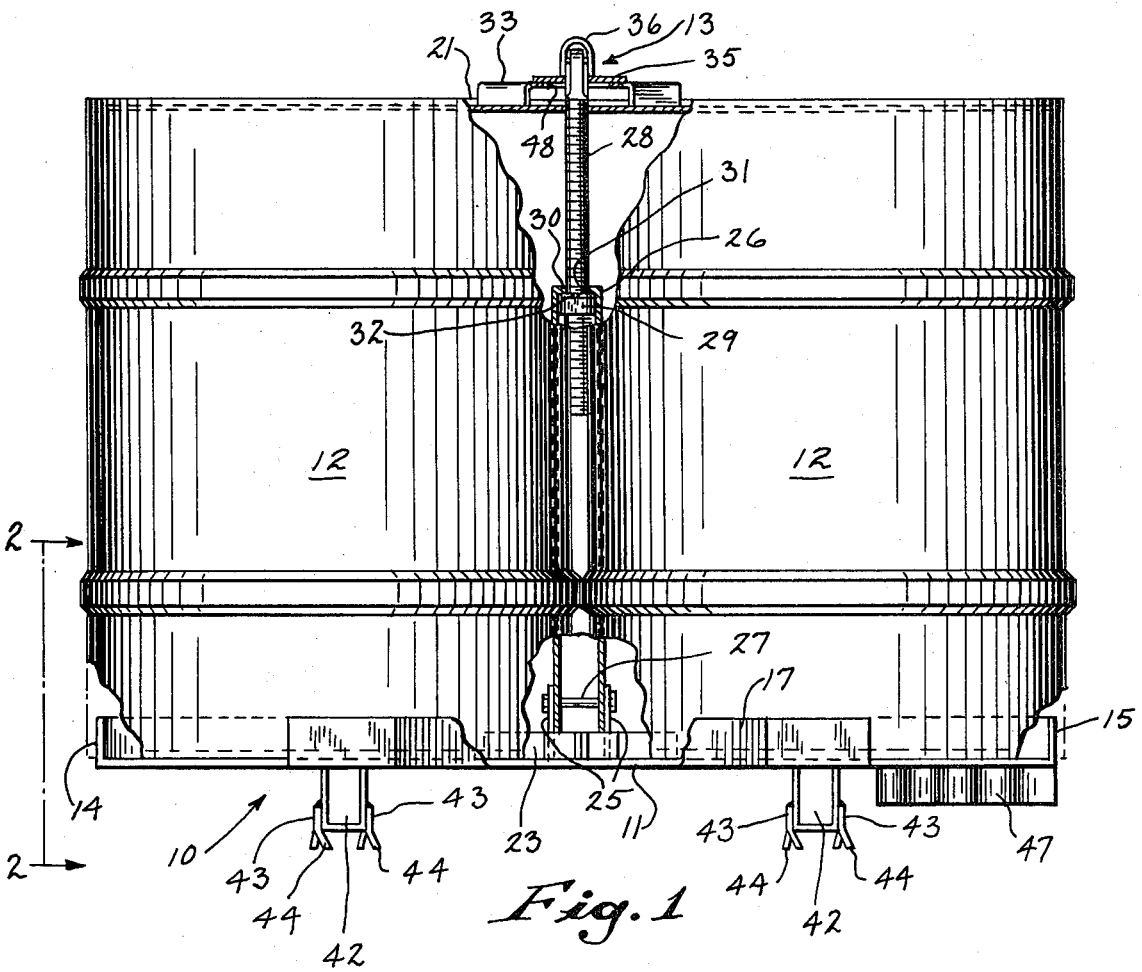
FIG. 1 is a rear elevation with parts broken away to better show the drum retaining means of this invention.

Referring to the drawings, the drum retaining means 10 generally comprise a supporting surface or platform 11 for supporting the drums 12 for shipment and/or storage, and a hold-down means 13 for securing the drums onto the platform and relative to each other.

Figure 3:
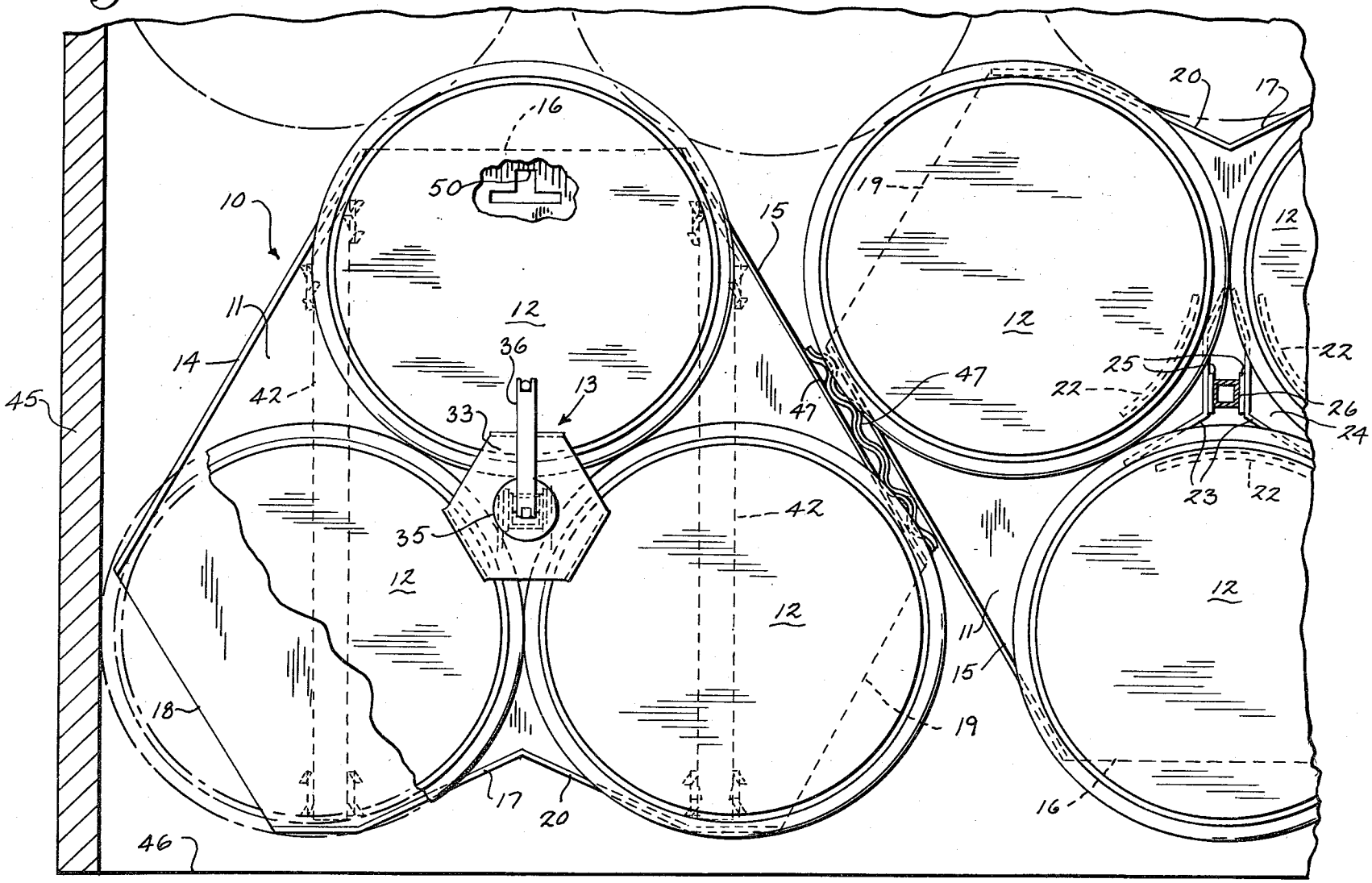
FIG. 3 is a partial plan view with parts broken away showing the loading of drums in a vehicle or the like utilizing the drum retaining means of this invention.

The platform 11 is of metal construction and generally hexagonally shaped and adapted to carry three (3) drums 12 resting on end and arranged triangularly with each drum generally contacting the other two drums as best shown in FIG. 3. The opposed, spaced side edges of the platform 11 extend generally tangentially relative to the corresponding drums 12 and have upturned drum confinement flanges 14 and 15 respectively. The single, forwardly disposed drum 12 on the left platform unit 11 shown in FIG. 3 is generally confined against undue movement forwardly by the spaced flanges 14 and 15 and projects therebetween and beyond the front edge 16 of the platform.

The rear edge of the platform 11 extends generally tangentially to the two rearwardly disposed drums 12 and generally parallels the front edge 16 and is provided with an upturned drum confinement flange 17. In the left platform unit 11 shown in FIG. 3, the drum 12 disposed rearwardly and to the left is generally confined against undue movement outwardly between the platform edge flanges 14 and 17 and projects therebetween beyond the side edge 18, while the drum disposed rearwardly and to the right is generally confined against undue movement outwardly by the edge flanges 15 and 17 and projects therebetween beyond the side edge 19. The rear flanged edge 17 is provided with a relatively wide V-shaped indentation 20 generally centrally thereof to enable still another drum 12 to enter the indentation and make contact with both rearwardly disposed drums as generally indicated by the inversely oriented retaining means 10 shown to the right in FIG. 3.

The respective ends of the drums 12 are formed with an axially extending flange or lip 21. Proper placement of the drums 12 on the platform 11 may be gauged interiorly of the platform by disposition of the corresponding portion of the bottom lip 21 between the generally arcuate, upwardly projecting lip retainers 22 and the upwardly projecting bolster plates 23 spaced inwardly from the lip retainers. While the upright projection of the lip retainers 22 is relatively small, being less than the axial depth of drum lip 21, they nevertheless also assist in confining the drums 12 against undue movement outwardly relative to the platform 11.

The opposed bolster plates 23 are welded to the platform 11 in the void 24 formed between the triangularly arranged drums 12. The plates 23 support a pair of transversely spaced and parallel mounting plates 25 which are welded to the bolster plates and extend upwardly therefrom to mount the hold-down means 13. The hold-down means 13 comprise a generally square tube 26 of which one end is disposed between the opposed mounting plates 25 and pivotally secured thereto by the pin 27 which extends transversely through the tube and the opposed plates in spaced relation above the bolster plates 23. When the tube 26 is raised into its vertical position it is disposed generally centrally of the void 24 formed by the drums 12 on the retaining means 10.

A rotatable threaded member 28 is disposed within the tube 26 and projects upwardly therefrom. A square nut 29 is turned on the threaded member 28 within the tube 26 and is slidable relative to the tube but confined against rotation therein. The end of tube 26 remote from the pivot connection 27 is swaged over inwardly to form a limit stop 30 for the nut 29 but provides for a hole 31 therein which is sufficiently large to pass the threaded member 28 between the nut 29 and the limit stop 30 of the tube 26. The end of the threaded member 28 inside the tube 26 may be deformed or other means may be resorted to to prevent the nut 29 from totally disengaging from the threaded member.

In service and as generally shown in FIG. 1, the hold-down means 13 are extended by withdrawing a substantial portion of the threaded member 28 from the tube 26 and raising the end of member 28 up above the top of drums 12. A hexagonally shaped hold-down bracket 33 is disposed on the threaded member 28 above the drums 12 and extends horizontally over the adjacent portions of the drum flanges 21. Alternate side edges of the bracket 33 are provided with downwardly extending flanges 34 which are adapted to engage upon the top of the corresponding drum 12. A bearing washer 35 is disposed on the threaded member 28 immediately above the bracket 33.

With the hold-down bracket 33 in place on the top of the drums 12, rotation of the threaded member 28 in the appropriate direction will draw the nut 29 and lock washer 32 upwardly tight against the limit stop 30 of tube 26. To effect such rotation and thereby apply a hold-down pressure on the drums 12 through the hold-down bracket 33, a handle 36 is provided on the threaded member 28 above the bearing washer 35. The handle 36 is pivotal on the pin member 37 carried at the upper end of threaded member 28 between a position generally axially aligned with the threaded member shown in dashed lines in FIG. 4 and a position generally normal to the threaded member. A crank lever 38 is provided on the handle 36 and extends normal thereto to provide leverage for turning the threaded member 28. When not in use, the crank 38 is pivotal into a handle cavity 39.

To turn the threaded member 28 and thereby draw the nut 29 up against the limit stop 30, the handle member 36 is disposed generally axially aligned with the threaded member. In that position the end of handle 36 adjacent to the pivot pin 37 bears down against the washer 35 and hold-down bracket 33. After the nut 29 is drawn upwardly tight against the limit stop 30, the handle 36 is pivoted to the solid line position generally normal to the threaded member 28 as shown in FIG. 4. A cam 40 is provided on the end of the handle member 36 adjacent to the pin member 37. The cam 40 is formed to provide an increasing radius relative to the pin member 37 as the handle 36 is pivoted toward its position generally normal to the threaded member 28 to impose an added increment of tension in the threaded member and thereby augment the hold-down pressure of the bracket 33 on the drums 12. The cam 40 terminates with a flat 41 to generally lock the handle 36 in the position generally normal to the threaded member 28.

The retaining means 10 further include a pair of transversely spaced, fore-and-aft extending runners 42 beneath the platform 11 to space the latter from the floor. The runners 42 are generally symmetrical with respect to the fore-and-aft extending centerline of the retaining means 10 and are transversely spaced a sufficient distance to permit the forks of a forklift truck to be inserted therebetween and beneath the platform 11. The transverse spacing between the runners 42 further provides that the runners will at least subtend the centers of the rear drums 12 and extend under at least the outer portions of the front drum 12 as generally shown in FIG. 3.

Figure 2:
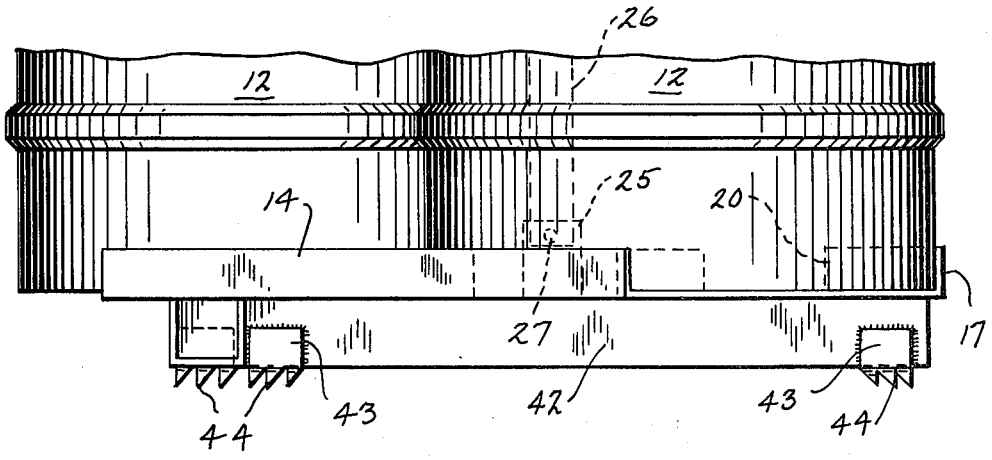
FIG. 2 is a partial side elevation taken generally on the line 2—2 of FIG. 1.

The stowage in most transport means for drums 12 is provided with a wood floor. To generally provide for the integrity of the load in storage, means are provided on the platform for runners 42 for digging into the wooden floor and thus generally restraining the retaining means 10 against movement in the fore-and-aft position. Such means can take the form of plates 43 having cleats or teeth 44 projecting beneath the runners. As shown in FIG. 2, the teeth or cleats 44 at the forward end of the runners 42 may project forwardly while the teeth or cleats 44 at the rearward end thereof may project to the rear so that the retaining means 10 will resist movement due to forces imposed from either end thereof. The teeth or cleats 44 on the respective plates 43 may be transversely offset as shown in FIG. 1, to stagger their gripping pattern.

With the use of the retaining means 10, drums 12 may be variously loaded in the stowage means for transport. If desired, all of the drums 12 making up a load may be secured on retaining means 10. Alternatively, part of a load may comprise free standing drums 12 which in effect are blocked by other drums 12 secured on such retaining means. FIG. 3 is illustrative of the loading of a truck trailer 45, shown only in part, wherein drums 12 may be free standing between the forward end of the trailer and the side-by-side, reversely oriented drum laden retaining means 10 disposed adjacent to the rear doorway 46. The substantial weight of the drum laden retaining means 10 adjacent to the rear of trailer 45 causes the cleats or teeth 44 thereof to dig into the wooden floor and thus serves to block the load of otherwise free standing drums 12. The reversely oriented retaining means 10, as shown in FIG. 3, extend generally the full width of a truck trailer 45 with but a few inches of clearance. A corrugated or sinuous strap 47 may be secured to the right upturned flange 15 of platform 11 of each retaining means 10 and which are interengaged when the retaining means are reversely oriented. The interengaged straps 47 are readily disengaged for unloading while rendering somewhat greater transverse stability to the drum laden retaining means 10 during transport.

Figure 6:
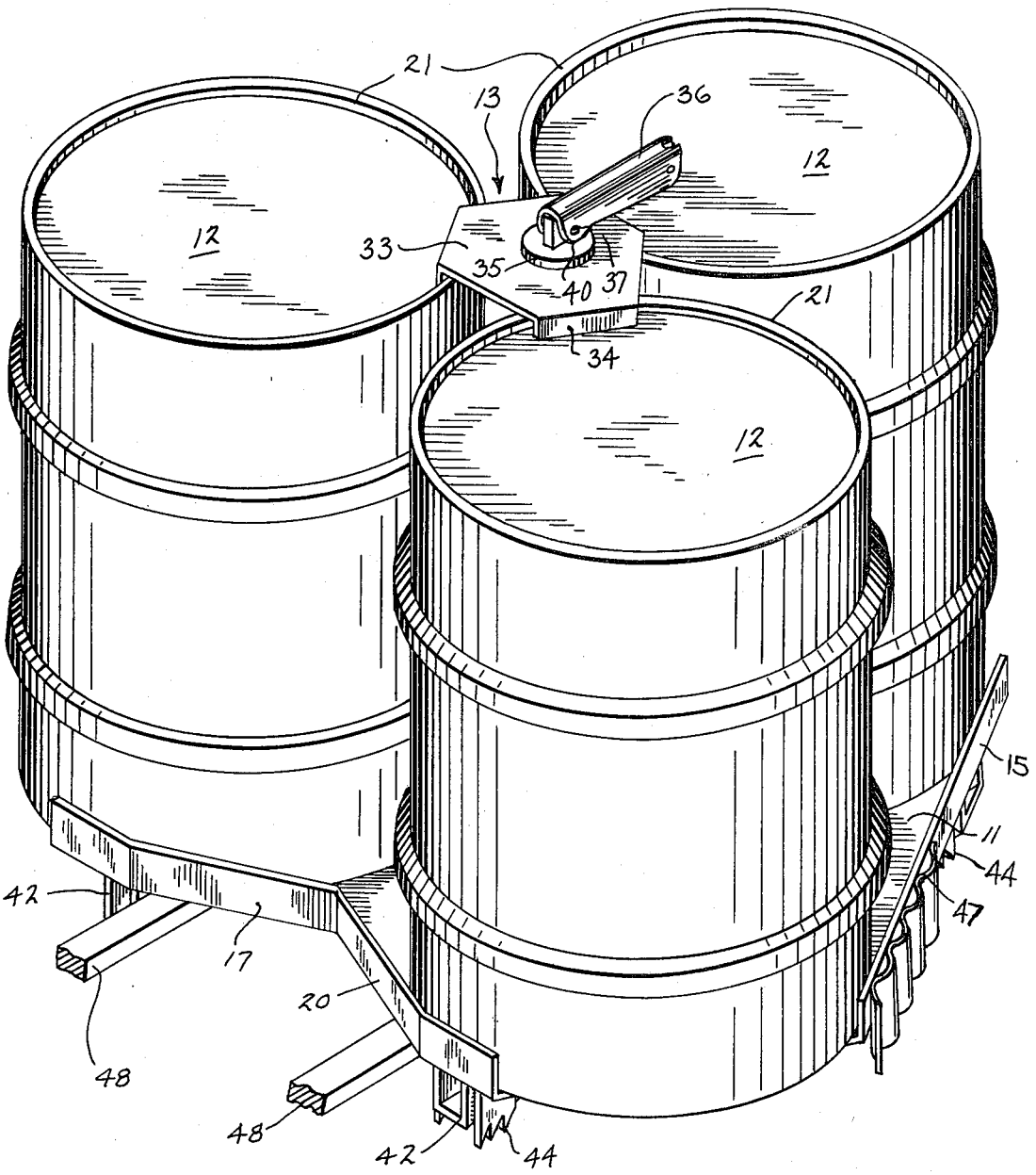
FIG. 6 is a rear isometric view of the retaining means of this invention laden with drums and shows the handling thereof as a unit.

FIG. 6 shows the drum laden retaining means 10 being handled as a unit with the forks 48 of a forklift truck, not shown, disposed under the platform 11 and between the runners 42.

To unload the drums 12 from the retaining means 10, the handle 36 is lifted to its raised position and turned to rotate the threaded member 28 to back the nut 29 away from the limit stop 30. The nut 29 is sufficiently far removed from stop 30 when the hold-down bracket 33 and threaded member 28 can be lifted high enough to permit drums 12 to move past the hold-down bracket and clear of the corresponding platform edge flanges.

After the drums 12 have been removed from the retaining means 10, the hold-down bracket 33 may be moved downwardly or dropped, and by virtue of the generally square central opening 49 therein will retain its given orientation relative to platform 11 and pass the tube 26 and bracket plates 25 and come to rest on the bolster plates 23 as generally shown in FIG. 4. The threaded member 28 is then also depressible into the square tube 26 with the bearing washer 35 coming to rest on the swaged end of the tube. With the threaded member 28 telescoped into the tube 26, the assembly is pivoted forwardly toward the platform 11 which is provided with an inverted, transversely centered T-slot 50 in spaced relation from the front edge 16. As perhaps best shown in FIG. 5, and with the crank lever 38 depressed into the handle cavity 39 and the handle 36 disposed normal to the threaded member 28, the square tube 26 will come to rest on the platform 11 with the bearing washer 35 and handle projecting downwardly into the T-slot 50.

Since the height of the fore-and-aft extending runners 42 together with the teeth 44 projecting downwardly therefrom exceeds the height of the mounting plates 25 pivotally mounting the nut confinement tube 26, the retaining means 10 are adapted for stacking and nesting thereof as generally shown in FIG. 5. Such stacking not only conserves space when not in use, but also serves to reduce the cost of deadheading the units back to their source for reuse.

Various modes of carrying out the invention are contemplated as being within the scope of the following claims particularly pointing out and distinctly claiming the subject matter which is regarded as the invention.

I claim:

1. In a retainer for a plurality of drums, platform means for supporting drums thereon disposed upright on end, hold-down means extending upright from the platform means, said drums being arranged circumferentially relative to the hold-down means and being engaged at their top by the hold-down means to provide for their securement between the hold-down means and the platform means, a plurality of floor contacting means disposed beneath the platform means to space the platform means above the floor, said floor contacting means having floor piercing means projecting downwardly therefrom to engage and pierce the floor and thereby generally restrain the drum retainer against movement, said hold-down means comprising a plate member adapted to seat on the tops of the drums, a tubular member connected to the platform means at the lower end thereof and having a closed upper end spaced beneath the plate member, a threaded member disposed in the tubular member and extending upwardly through generally aligned openings in the upper end of the tubular member and the plate member, a nut engaged on said threaded member inside said tubular member, said nut being slideable relative to the tubular member and confined against rotation therein, said threaded member being rotatable to drive the nut upwardly against the closed end of the tubular member, and means disposed above the plate member and associated with the threaded member to impose a hold-down pressure on the plate member when the nut is driven tightly against the closed end of the tubular member.

2. The structure as set forth in claim 1 wherein the floor piercing means are teeth provided at the respective ends of the runners.

3. The structure as set forth in claim 1 wherein the floor piercing means are teeth provided at the respective ends of the runners, with said teeth at the forward end of the runners projecting downwardly and forwardly and the teeth at the rear end of the runners projecting downwardly and rearwardly to generally resist movement due to forces imposed from either the forward direction or the rear direction.

4. The structure as set forth in claim 1 wherein the platform means has a capacity for supporting three drums.

5. The structure as set forth in claim 1 wherein the means associated with the threaded member to impose a hold-down pressure on the plate member includes a handle member which is pivotally attached adjacent to the upper end of the threaded member, said handle member being pivotal between a position generally axially aligned with the threaded member and a position generally normal to the threaded member, and cam means on the handle member adjacent to the handle member pivot axis, said cam means providing an increasing radius relative to the pivot axis when the handle member is pivoted from the axially aligned position toward the normal position thereof to impose an added increment of hold-down pressure on the plate member and terminating with a flat to generally lock the handle member in the position generally normal to the threaded member.

6. The structure as set forth in claim 1 wherein the tubular member section comprises a regular polygon and the nut engaged upon the threaded member has sides corresponding to the tubular member section.

7. The structure as set forth in claim 1 wherein the tubular member telescopically receives the threaded member and is pivotally connected to the platform means, said tubular member with telescoped threaded member being pivotal to a generally horizontal position at rest on the platform means when the drum retainer is not in use.

8. The structure as set forth in claim 1 wherein the hold-down means are vertically extendible and adapted to exert a pressure on the top of the drums.

9. The structure as set forth in claim 1 wherein the hold-down means are pivotally connected to the platform means for movement between the upright position and a generally horizontal position, said generally horizontal position for the hold-down means providing for stacking and nesting of the drum retainer when not in use.

10. In a retainer for a plurality of drums, platform means for supporting drums thereon disposed upright on end, said platform means having a forward edge and a rear edge and being generally symmetrical relative to a fore-and-aft extending centerline, hold-down means extending upright from the platform means, said drums being arranged circumferentially relative to the hold-down means and being engaged at their top by the hold-down means to provide for their securement between the hold-down means and the platform means, and a pair of fore-and-aft extending, transversely spaced runners disposed a given distance on opposite sides of said centerline and beneath the platform means to space the platform means above the floor, said runners having floor piercing means projecting downwardly therefrom to engage and pierce the floor and thereby generally restrain the drum retainer against movement, wherein the platform means has a capacity for supporting three drums arranged triangularly and in contact with each other, one of said drums being disposed forwardly with its centerline generally intersecting said centerline of the platform means and the other two drums being disposed rearwardly and generally symmetrically with respect to said centerline of the platform means, and with said runners generally extending beneath the centerlines of the rearwardly disposed drums and beneath the opposed outer portions of the forwardly disposed drum.

11. The structure as set forth in claim 10 wherein the rear edge of the platform means is provided with a V-shaped indentation for receiving an adjacently disposed drum therein in contact with the rearwardly disposed drums on the platform means.

12. The structure as set forth in claim 10 wherein the side edges and rear edge of the platform means are provided with upturned flanges to generally preclude movement of the drums outwardly relative to the platform means.

13. In a retainer for a plurality of drums, platform means for supporting drums thereon disposed upright on end, hold-down means pivotally connected to the platform means, said drums being arranged circumferentially relative to the hold-down means and being engaged at their top by the hold-down means disposed in uprightly extending condition to provide for securement of the drums relative to the platform means, said hold-down means being pivotal to a generally horizontal position at rest on the platform means when the retainer is not in use, wherein the hold-down means comprise a plate member adapted to seat on the tops of the drums, a tubular member pivotally connected to the platform means and having a closed end remote therefrom, a threaded member disposed in the tubular member and extending therefrom through the closed remote end thereof and through the plate member, a nut engaged on said threaded member inside said tubular member, said nut being slideable relative to the tubular member to provide for telescoping movement between the threaded member and the tubular member and being confined against rotation therein, said threaded member being rotatable to drive the nut against the closed end of the tubular member, and means on the end of the threaded member rotate from the tubular member to impose a hold-down pressure on the plate member when the nut is driven tightly against the closed end of the tubular member.

* * * * *